United States Patent [19]

Sarich

[11] Patent Number: 4,519,356

[45] Date of Patent: May 28, 1985

[54] INTERNAL COMBUSTION ENGINE FUEL AND AIR SYSTEM

[75] Inventor: Tony R. Sarich, Karrinyup, Australia

[73] Assignee: Orbital Engine Company Proprietary Limited, Balcatta, Australia

[21] Appl. No.: 454,658

[22] Filed: Dec. 30, 1982

[30] Foreign Application Priority Data

Dec. 31, 1981 [AU] Australia ..... PF2126

[51] Int. Cl.[3] ..... F02M 69/08

[52] U.S. Cl. ..... 123/533; 123/531

[58] Field of Search ..... 123/531–535, 123/445

[56] References Cited

U.S. PATENT DOCUMENTS

| | | | |
|---|---|---|---|
| 1,868,767 | 7/1932 | Ross | 123/531 |
| 2,280,317 | 4/1942 | Stehle et al. . | |
| 2,706,976 | 4/1955 | Gianini | 123/533 X |
| 4,376,423 | 3/1983 | Knapstein | 123/533 X |

FOREIGN PATENT DOCUMENTS

| | | |
|---|---|---|
| 282163 | 6/1965 | Australia . |
| 523968 | 12/1979 | Australia . |
| 777751 | 2/1935 | France . |
| 879823 | 3/1943 | France . |
| 1098823 | 1/1968 | United Kingdom . |
| 2018906 | 7/1979 | United Kingdom . |

*Primary Examiner*—Tony M. Argenbright

*Attorney, Agent, or Firm*—Murray, Whisenhunt and Ferguson

[57] ABSTRACT

A liquid fuel supply for an internal combustion engine wherein the fuel is circulated in a closed circuit including a fuel reservoir and a fuel metering device, delivering the fuel from the metering device to the engine by admitting compressed air to the metering device, the compressed air being supplied by a compressor that draws air and fuel vapor from the fuel reservoir. The residual gas in the metering device being entrained in the circulating fuel and returned to the fuel reservoir.

19 Claims, 3 Drawing Figures

INTERNAL COMBUSTION ENGINE FUEL AND AIR SYSTEM

BACKGROUND OF THE INVENTION

This invention relates to a fuel and pressure gas supply system for an internal combustion engine having a gas pressure operated fuel metering and/or injecting apparatus. There are a number of internal combustion engines which use air under pressure in association with the admission of the fuel supply to the engine. One fuel metering system using air pressure as a means of delivery of the fuel is disclosed in the Applicant's co-pending application Ser. No. 532,035, based on Australian Patent Application No. PF2123/81.

The majority of fuel supply systems of the above type the fuel is drawn from the fuel tank through the fuel metering system and the excess fuel returned to the tank. It is also common for air to become entrained in the fuel returned to the tank and thus a mixture of fuel and fuel vapour is returned to the tank. Also in some of the air pressure operated fuel systems, such as the one referred to in the above co-pending application, there is air exhausted from the system, and under current pollution requirements, such air cannot be exhausted directly into the atmosphere.

SUMMARY OF THE INVENTION

It is therefore the principal object of the present invention to provide in combination with an internal combustion engine a fuel and air supply system which avoids the exhausting of fuel contaminated air to atmosphere and makes advantageous use of the fuel vapour available in the system.

With this object in view there is provided by the present invention a method of supplying fuel by gas pressure to an internal combustion engine comprising circulating fuel from a fuel reservoir through a fuel metering device, delivering a metered quantity of fuel from the metering device to the engine by pressurized gas, returning the excess fuel with entrained gas from the metering device to the fuel reservoir, compressing gas including fuel vapour drawn from the fuel reservoir and supplying said compressed gas and fuel vapour to said metering device to effect said delivery of fuel to the engine.

Conveniently there is also provided according to the present invention, in combination with an internal combustion engine having a gas pressure operated fuel metering and/or injecting device, a gas cicuit including a compressor to supply gas under pressure to the fuel device and a gas reservoir from which gas is drawn by the compressor and to which gas is returned from the fuel device, a fuel circuit including a fuel pump, to supply fuel to the fuel device and a fuel reservoir from which fuel is drawn by the pump and fuel and gas are returned by the pump, said air reservoir and fuel reservoir being in communication so that the compressor may draw gas including fuel vapor from both reservoirs.

The invention is particularly applicable to supplying liquid fuel to an engine by a compressed air operated fuel metering and/or injection device.

Conveniently the return air and return fuel are combined in the vicinity of the metering and/or injecting device and returned through a single line to a common reservoir which acts as both the air reservoir and fuel reservoir. This reservoir may be the fuel tank of the engine, and is constructed so that the compressor may withdraw air from an area of the fuel tank without the risk of liquid fuel being drawn into the compressor. This can be achieved by suitable shaping and baffling of the fuel tank, and as a further precaution a liquid separator may be incorporated in the air ciruit between the tank and compressor.

Preferably the air supply line from the air reservoir to the compressor is also in communication with the air induction passage of the engine, so that excess vapours in the reservoir may be drawn into the engine, if the compressor is not capable of handling the volume of vapour available under any particular operating condition. Also, under normal operating conditions, the air and vapour available from the reservoir may frequently be less than the compressor demand, and so make-up may be drawn from the engine air induction system.

The above described system has the advantage that there is no loss of fuel in vapour form from the fuel system, which would lead to an overall increase in fuel consumption. Also this system avoids the exhausting of fuel vapour laden air into the atmosphere with the potential resultant pollution of the atmosphere.

When the fuel metering system, as disclosed in the above referred to co-pending patent application, is operating, the metering chamber is filled with air at the completion of each fuel metering and delivery cycle. Accordingly upon commencement of the next cycle, the circulation of fuel through the metering chamber results in the residual air in the chamber becoming entrained with the fuel and is expelled from the metering chamber through the return fuel line to the fuel tank. This action results in the generation of a significant quantity of vapour in the fuel tank, and the system now proposed conveniently disposed of the vapour by supplying it to the compressor where it is compressed and resupplied to the metering system.

DETAILED DESCRIPTION OF THE INVENTION

The invention will be more readily understood from the following description of one practical arrangement of the fuel injection supply system of the invention as illustrated in the accompanying drawings, in which.

In the following description the method and apparatus of the invention is considered to be applied to a conventional internal combustion engine such as is generally fitted to automobiles, however, it will be appreciated that it is equally applicable to other types of internal combustion engine in other applications.

Figure 1:
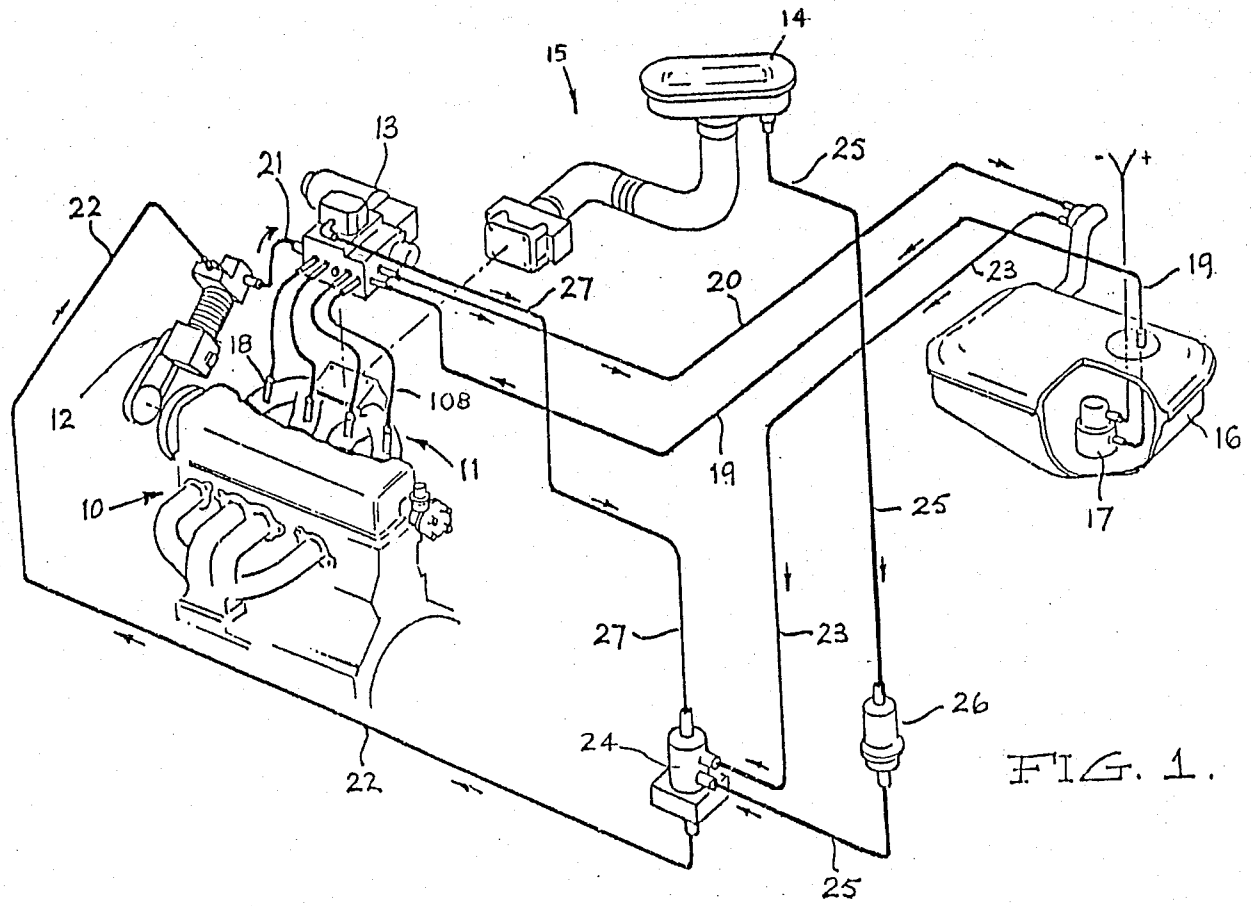
FIG. 1 is a schematic representation of one practical application of the fuel injection supply system.

Referring to FIG. 1, there is shown an internal combustion engine 10 having an inlet manifold 11 arranged to distribute a combustible fuel/gas mixture to the combustion chambers of the engine. In addition to the usual auxilliary components (alternator, cooling fan), the engine 10 drives an air compressor 12, the purpose of which will become clear from the description to follow. Associated with the inlet manifold 11 is a fuel injection metering unit 13 of the type described in applicant's aforesaid co-pending patent application, and delivers metered quantities of fuel into the manifold 11 through nozzles 18.

A fresh air cleaner or filter 14 as usually provided on an internal combustion engine enables fresh air to be drawn therethrough by the inlet manifold vacuum via conduits 15.

Fuel for the engine 10 is stored in a fuel reservoir 16, which is provided with an electrically operated low pressure fuel pump 17. Alternatively, the fuel pump 17 may be of the mechanical type driven directly or indirectly by the crankshaft or camshaft of engine 10, in which case the pump 17 would be mounted on the engine to draw fuel from the reservoir 16. Pump 17 delivers fuel from reservoir 16 to metering unit 13 through fuel line 19, for distribution to the combustion chambers of engine 10 as described in the above mentioned co-pending patent application. Excess fuel from the metering unit 13 is returned to reservoir 16 by return fuel line 20. Because of the construction and method of operation of metering unit 13, the excess fuel returned to reservoir 16 will include some fuel vapour.

Compressed air for the metering unit 13 is provided by compressor 12, and is supplied to the metering unit through air line 21. Compressor 12 draws its supply of air for compression from the air/fuel vapour above the fuel in reservoir 16, through air lines 22, 23 via a mixing tee 24. Additional fresh air as required is drawn through air cleaner 14, fresh air line 25, charcoal filter 26 to mixing tee 24.

Figure 2:
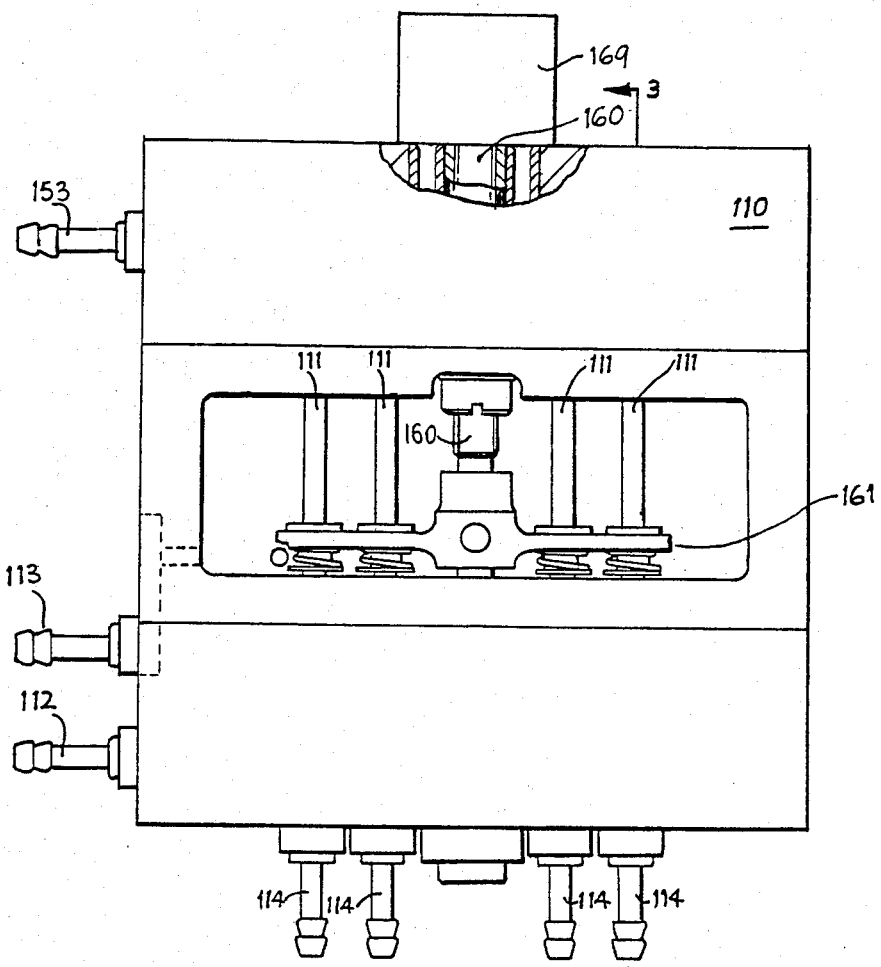
FIG. 2 is a plan view of the metering apparatus described in copending application Ser. No. 532,035.
Figure 3:
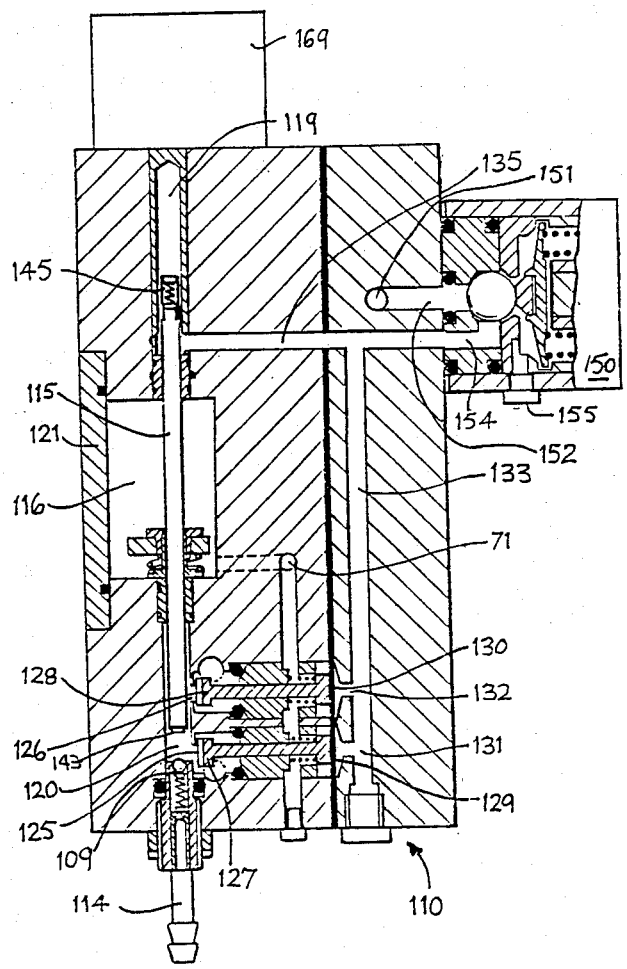
FIG. 3 is a sectional view of the metering unit of FIG. 2, taken along the axis of one of the metering units.

Referring now to FIGS. 2 and 3 of the drawings, the metering apparatus 13 of the aforementioned co-pending patent application comprises a body 110, having incorporated therein four individual metering units 111 arranged in side by side parallel relationship. The nipples 112 and 113 are adapted for connection to fuel supply line 19 and fuel return line 20 respectively, and communicate with respective galleries within the block 110 for the supply and return from each of the metering units 111. Each metering unit 111 is provided with an individual fuel delivery nipple 114 to which a line may be connected to communicate the metering unit with the injection nozzle.

FIG. 3 shows the metering rod 115 extending into the air supply chamber 119 and metering chamber 120. The metering rods 115 passes through the common leakage collection chamber 116 which is formed by a cavity provided in the body 110 and the coverplate 121 attached in sealed relation to the body 110.

The metering rod 115 is axially slidable in the body 110 and the extent of projection of the metering rod into the metering chamber 120 may be varied to adjust the quantity of fuel displacable from the metering chamber. The valve 143 at the end of the metering rod located in the metering chamber is normally held closed by the spring 145 to prevent the flow of air from the air supply chamber 119 to the metering chamber 120. Upon the pressure in the chamber 119 rising to a predetermined value the valve 143 is opened to admit the air to the metering chamber, and thus displace the fuel therefrom.

Each of the metering rods 115 are coupled to the crosshead 161, and the crosshead is coupled to the actuator rod 160 which is slidably supported in the body 110. The actuator rod 160 is coupled to the motor 169, which is controlled in response to the engine fuel demand, to adjust the extent of projection of the metering rods in the metering chambers 120 so the metered quantity of fuel delivered by the admission of the air is in accordance with the fuel demand.

The fuel delivery nipples each incorporate a pressure actuated valve 109 which opens in response to the pressure in the metering chamber 120 when the air is admitted thereto from the air supply chamber 119. Upon the air entering the metering chamber through the valve 143 the delivery valve 109 also opens and the air will move towards the delivery valve displacing the fuel from the metering chamber through the delivery valve. The valve 143 is maintained open until sufficient air has been supplied to displace the fuel between the valves 143 and 109 from the chamber along the delivery line 108 to the nozzle 18.

The quantity of fuel displacable from the chamber 120 by the air is the fuel located in that portion of the chamber 120 located between the point of entry of the air to the chamber, and the point of discharge of the fuel from the chamber, this is the quantity of fuel between the air admission valve 143 and the delivery valve 109.

Each metering chamber 120 has a respective fuel inlet port 125 and a fuel outlet port 126 controlled by respective valves 127 and 128 to permit circulation of fuel through the chamber. Each of the valves 127 and 128 are spring-loaded to an open position, and are closed in response to the application of air under pressure to the respective diaphragms 129 and 130 located in diaphragm cavities 131 and 132. Each of the diaphragm cavities are in constant communication with the air conduit 133 and the conduit 133 is also in constant communication with the air supply chamber 119 by the conduit 135. Thus, when air under pressure is admitted to the chamber 119 to effect delivery of fuel, the diaphragms 129 and 130 close the fuel inlet and outlet ports 125 and 126.

The control of the supply of air to the conduit 133, and hence the supply of air to the supply chamber 119 and the diaphragm cavities 131 and 132, is controlled in time relation with the cycling of the engine through the solenoid operated valve 150. The common air supply conduit 151 connected to air line 21 from compressor 12 via nipple 153, runs through the body with respective branches 152 providing air to the solenoid valve 150 of each metering unit. The operation of the solenoid valve 150 may also be controlled to vary the duration of the period that air is supplied to the air chamber 119, to ensure the fuel displaced from the metering chamber is delivered through the nozzle 18.

The admission of the air to the metering chamber may be controlled by an electronic processor, activated by signals from the engine that sense the fuel demand of the engine. The processor may be programmed to vary the frequency and duration of admission of the air to the metering chamber.

Full details of the operation of the metering apparatus can be obtained from applicant's co-pending application Ser. No. 532,035 based on Australian Patent Application No. PF2123/81 and that disclosure is hereby incorporated in this specification.

During the operation of metering unit 13, the pressure of the air in conduits 133 and 135, must be relieved, during each injection cycle, and this air is bled through conduit 154 and into line 27 connected to port 155 of solenoid valve 150, and then into mixing tee 24 for return to compressor 12. Air and fuel leakage collected in the chamber 116 drains via the conduit 71 to nipple 113 and returned to the fuel tank 16 through fuel return line 20.

From the foregoing description, it will be appreciated that the fuel and air supply system for the metering unit 13 is closed against leakage to atmosphere, thereby preventing polluted air or fuel being released to atmosphere. It will be seen that the only contact the system has with the atmosphere, is through fresh air line 25, however, contaminated air cannot leave the system whilst the engine is running, and when the engine is stationary air must pass through the charcoal filter 26 before it is released to atmosphere. Normally the only losses from the system under operating conditions is the air and fuel that is delivered to the injector nozzles from the metering chambers. When excess vapour is developed in the fuel reservoir 16 such as in high ambient temperatures conditions, the vapour is released through the filter 26 wherein the fuel is separated from the air. The fuel retained in the filter is picked up when fresh air is subsequently drawn into the system.

I claim:

1. Apparatus for supplying liquid fuel by gas pressure to an engine comprising a gas circuit including a means to supply compressed gas to a fuel metering device and a gas reservoir from which gas is drawn by said means and to which gas or gas and fuel are returned from the fuel metering device, a liquid fuel circuit including means to supply liquid fuel to the fuel metering device a liquid fuel reservoir from which liquid fuel is drawn by said means and to which fuel or gas and fuel are returned from the liquid fuel metering device, said gas reservoir and fuel reservoir being in communication so that the compressed gas supply means may draw gas including entrained fuel vapour from both reservoirs.

2. Apparatus as claimed in claim 1 wherein the liquid fuel and gas circuits are combined in the vicinity of the metering device so the return gas and liquid fuel pass through a common conduit to a common reservoir which acts as both the gas reservoir and liquid fuel reservoir.

3. Apparatus for supplying liquid fuel by gas pressure to an engine comprising a metering device, a liquid fuel reservoir, means to supply liquid fuel from the reservoir to the metering device, means to deliver a compressed gas/fuel vapour mixture drawn from the reservoir to the metering device, said metering device being adapted to deliver a metered quantity of liquid fuel upon admission of the compressed gas/fuel vapour mixture thereto, and means to return excess liquid fuel and entraind gas from the metering device to the reservoir.

4. Apparatus according to claim 3 including means to return gas, fuel fuel and gas/fuel vapour leaked from the chamber in the metering device to the means to deliver compressed gas/fuel vapour mixture to the metering device.

5. Apparatus according to claim 4 wherein the leaked gas, liquid fuel and gas/fuel vapour is returned to the liquid fuel reservoir.

6. Apparatus according to claim 3 wherein the compressing means is adapted to draw air from another source to be compressed with the gas/fuel vapour mixture.

7. Apparatus according to claim 6 wherein the engine includes air induction system and said compressing means is adapted to draw air therefrom.

8. Apparatus for delivering a metered quantity of liquid fuel to an engine comprising a chamber having a selectively openable discharge port, means to circulate liquid fuel from a liquid fuel reservoir through said chamber to fill the chamber with liquid fuel preparatory to delivery, means to compress a gas/fuel vapour mixture drawn from said liquid fuel reservoir for delivery to said chamber, means operable to selectively admit the compressed gas/fuel vapour mixture to the chamber at a pressure sufficient to displace the liquid fuel therefrom upon opening of the discharge port, and means to control the quantity of liquid fuel displaceable from the chamber by the admission thereto of the gas/fuel vapour mixture, and means to return excess liquid fuel, gas and fuel vapour from said chamber to said liquid fuel reservoir.

9. Apparatus according to claim 8 wherein the chamber is provided with a gas/fuel vapour mixture inlet port, and said means to control the quantity of liquid fuel displaceable includes a member forming portion of said chamber and having said inlet port formed therein, said member being movable relative to the discharge port in said chamber so that the quantity of liquid fuel displaceable by the admission of the gas/fuel vapour mixture is determined by the position of said inlet port relative to the discharge port.

10. A method of supplying liquid fuel by gas pressure to an engine comprising circulating liquid fuel from a liquid fuel reservoir through a fuel metering device, compressing gas or a gas/fuel vapour mixture drawn from the liquid fuel reservoir and supplying said compressed gas or gas/fuel vapour mixture to said metering device, delivering a metered quantity of liquid fuel from the metering device to the engine by the admission of the compressed gas or gas/fuel vapour mixture to the metering device, and returning the excess liquid fuel with entrained gas and/or fuel vapour from the metering device to the liquid fuel reservoir.

11. A method according to claim 10 wherein the engine has an air induction system and air therefrom may be added to the gas or gas/fuel vapour mixture drawn from the liquid fuel reservoir to be compressed therewith for supply to the fuel metering device.

12. A method according to claim 10 wherein leakage gas liquid fuel and fuel vapour accumulated in the metering device is added to the gas/fuel vapour mixture to be compressed therewith for supply to the fuel metering device.

13. A method according to claim 12 wherein the leakage gas liquid fuel and fuel vapour are returned to the liquid fuel reservoir.

14. A method of delivering a metered quantity of liquid fuel to an engine comprising circulating liquid fuel from a liquid fuel reservoir through a chamber to fill the chamber with liquid fuel, compressing gas or a gas/fuel vapour mixture drawn from said liquid fuel reservoir, admitting said compressed gas/fuel vapour mixture to said chamber when the chamber is isolated from the liquid fuel circuit to displace liquid fuel from the chamber when a discharge port in the chamber is opened, controlling the quantity of liquid fuel displaceable by the admission of the compressed gas/fuel vapour mixture to deliver a metered quantity of liquid fuel to the engine, and returning liquid fuel and gas/fuel vapour mixture from the chamber to the liquid fuel reservoir after completion of the delivery of the metered quantity of liquid fuel.

15. A method as claimed in claim 14 wherein gas liquid fuel and fuel vapour leaked from the chamber is collected and added to the gas/fuel vapour mixture to be compressed therewith for admission to the chamber.

16. A method of supplying liquid fuel to an engine comprising circulating liquid fuel from a liquid fuel reservoir through a fuel metering device back to the liquid fuel reservoir, and periodically delivering a metered quantity of fuel from the metering device to the engine by compressing gas or a gas/fuel vapour mixture drawn from the liquid fuel reservoir, supplying the compressed gas or gas/fuel vapour mixture to said metering device, admitting the compressed gas or gas/fuel vapour mixture to the metering device to deliver said metered quantity of fuel from the metering device to the engine, and returning entrained gas with the recirculated liquid fuel from the metering device to the liquid fuel reservoir.

17. A method of supplying liquid fuel by gas pressure to an engine comprising circulating fuel from a fuel reservoir through a fuel metering device, compressing gas or a gas/fuel vapour mixture drawn from the fuel reservoir and supplying said compressed gas or gas/fuel vapour mixture to said metering device, delivering a metered quantity of fuel from the metering device to the engine by the admission of the compressed gas or gas/fuel vapour mixture to the metering device, returning the excess fuel with entrained gas from the metering device to the fuel reservoir, and adding leakage gas, fuel and fuel vapour accumulated in the metering device to the gas/fuel vapour mixture to be compressed therewith for supply to said fuel metering device.

18. Method according to claim 17, wherein the leakage gas, fuel and fuel vapour are returned to the fuel reservoir.

19. A method of delivering a metered quantity of liquid fuel to an engine comprising circulating liquid fuel from a fuel reservoir through a chamber to fill the chamber with fuel, compressing gas or a gas/fuel vapour mixture drawn from said fuel reservoir, admitting said compressed gas/fuel vapour mixture to said chamber when the chamber is isolated from the fuel circuit to displace fuel from the chamber when a discharge port in the chamber is opened, controlling the quantity of fuel displaceable by the admission of the compressed gas/fuel vapour mixture to deliver a metered quantity of fuel to the engine, returning fuel and gas/fuel vapour mixture from the chamber to the fuel reservoir after completion of the delivery of the metered quantity of fuel, collecting gas, fuel and fuel vapour leaked from the chamber, and adding the collected gas, fuel and fuel vapour to the gas/fuel vapour mixture to be compressed therewith for admission to said chamber.

* * * * *